US005433444A

United States Patent [19]

Chiuminatta et al.

[11] Patent Number: 5,433,444

[45] Date of Patent: Jul. 18, 1995

[54] TARGETING PUTTER

[76] Inventors: Alan R. Chiuminatta, 16862 Mariposa Ave.; Edward Chiuminatta, 16405 Everett, both of Riverside, Calif. 92504

[21] Appl. No.: 141,113

[22] Filed: Oct. 22, 1993

[51] Int. Cl.[6] ..... A63B 53/04

[52] U.S. Cl. ..... 273/164.1; 273/167 F; 273/171; 273/194 A; 273/194 B

[58] Field of Search ..... 273/186.2, 35 R, 35 A, 273/162 B, 163 R, 163 A, 164.1, 167 F, 169, 170, 171, 173, 183.1, 187.4, 187.6, 194 R, 194 A, 194 B

[56] References Cited

U.S. PATENT DOCUMENTS

| | | | |
|---|---|---|---|
| Re. 19,178 | 5/1934 | Spiker | 273/169 X |
| D. 233,535 | 11/1974 | Karban | D21/2 |
| D. 234,782 | 4/1975 | Creed | D21/2 |
| D. 245,438 | 8/1977 | Thiel | D21/2 |
| 1,327,171 | 1/1920 | Ruggles | 273/163 R |
| 1,556,062 | 10/1925 | Baugh | 273/163 R X |
| 1,993,928 | 3/1935 | Glover | 273/169 |
| 2,460,445 | 2/1949 | Bigler | 273/170 |
| 2,463,291 | 3/1949 | Mazziotti | 273/163 R |
| 2,463,798 | 3/1949 | Paisley | 273/163 R |
| 2,822,614 | 2/1958 | Susinno | 273/163 R |
| 3,019,022 | 1/1962 | Ehmke | 273/173 X |
| 3,043,596 | 7/1962 | Ehmke | 273/173 X |
| 3,273,891 | 9/1966 | Grim | 273/163 R |
| 3,374,027 | 3/1968 | Jacobs | 273/169 X |
| 3,403,912 | 10/1968 | Maroun | 273/194 A |
| 3,507,500 | 4/1970 | Scott | 273/186.2 |
| 3,845,960 | 11/1974 | Thompson | 273/171 |
| 3,873,094 | 3/1975 | Sebo et al. | 273/169 X |
| 3,966,210 | 6/1976 | Rozmus | 273/169 |
| 4,324,404 | 4/1982 | Dian | 273/169 |
| 4,367,877 | 1/1983 | Gibson et al. | 273/164.1 |
| 4,390,184 | 6/1983 | Rudell | 273/187 A |
| 4,529,202 | 7/1985 | Jacobson | 273/169 X |
| 4,569,523 | 2/1986 | Jarvis | 273/169 X |
| 4,601,472 | 7/1986 | O'Flanagan | 273/163 R X |
| 4,695,054 | 9/1987 | Tunstall | 273/171 |
| 4,828,266 | 5/1989 | Tunstall | 273/171 |
| 4,834,387 | 5/1989 | Waites et al. | 273/169 X |
| 4,844,468 | 6/1989 | Lee | 273/163 R |
| 4,927,144 | 5/1990 | Stormon | 273/171 X |
| 4,953,866 | 9/1990 | Bang | 273/164.1 X |
| 4,962,932 | 10/1990 | Anderson | 273/171 |
| 4,979,744 | 12/1990 | Alcala | 273/169 |
| 5,050,879 | 9/1991 | Sun et al. | 273/171 X |
| 5,071,129 | 12/1991 | Wilson | 273/163 R X |
| 5,116,047 | 5/1992 | Phelan et al. | 273/171 X |
| 5,193,806 | 3/1993 | Burkly | 273/171 X |
| 5,253,869 | 10/1993 | Dingle et al. | 273/171 X |

*Primary Examiner*—William H. Grieb

*Attorney, Agent, or Firm*—Knobbe, Martens Olson & Bear

[57] ABSTRACT

A targeting putter having improved alignment and swing compensation means is disclosed. The putter comprises a putter shaft and a putter head having a striking face, heel and toe ends, and a reflective prism mounted thereon. The reflective prism, which is a right triangle prism, is located above the striking face of the putter head, and has a concave top or front face such that a wide-angle image of the green in front of the putter head is reflected to the eye of a golfer viewing the putter head from above. Reticles on the front and top faces of the reflective prism enable the golfer to sight through the prism, across the ball and to the pin, and to align the putter head perpendicularly to the intended path. A set of rotatably adjustable swing-weights are located in counterbores in the rearward face of the putter head, allowing the center of mass of the putter head to be easily shifted in both the toe-to-heel and top-to-bottom directions. Such adjustments allow for compensation of deficiencies in the golfer's stroke that tend to twist the putter head, or put too much or too little force into the swing.

19 Claims, 5 Drawing Sheets

TARGETING PUTTER

FIELD OF THE INVENTION

The present invention relates to an improvement in golf putters. More specifically, the present invention relates to a golf putter which incorporates an optical sighting system and a putter head weight adjustment system to improve aim and stroke accuracy in putting a golf ball.

BACKGROUND OF THE INVENTION

In putting a golf ball, the golfer must determine the proper direction in which to putt the ball, align the putter head perpendicular to that direction, judge the distance and the force necessary to get the ball to the hole, and follow through with a putt that deviates in neither force nor aim from the intended stroke. This complex set of tasks is complicated by the imprecision of the human eye, including its location several feet above the playing surface and often several yards from the hole or target. Further, most golfers have a tendency to putt too hard or too soft, or to "pull" or "push" the putter with their stronger hand, thus twisting the putter during backstroke so that the putting head is not retained perpendicular to the intended path when it strikes the ball.

A variety of improvements and additions to golf putters have been devised to correct some of these human deficiencies. One such improvement is described in U.S. Pat. No. 3,019,022. This patent discloses a golf putter incorporating a triangular reflective prism in its head, disposed laterally behind and substantially at the level of the striking face, and extending substantially from the heel to the toe of the putting head. The reflective surface of the prism is disposed such that the image from the putting face is reflected upward towards the user. Two reticles are provided, one on each transparent surface of the prism. In operation, the golfer sights both the ball and the pin through the top of the prism, and through the means of two reticles aligns the striking face of the club so that it is perpendicular to the intended path. However, this device has the disadvantage that, because the prism forms the striking face, the ball largely obscures the pin, making location of the pin difficult.

Additionally, this device and other previous putters having similar sighting systems have suffered from the disadvantage that once the putter head has been positioned, no means exists to correct the golfer's stroke so that the putter head will remain properly aligned upon contact with the ball.

It is well known in the art that "swingweighting" a club—shifting its center of mass or changing its weight—can correct for stroke deficiencies. Shifting the center of mass toward the toe of the club can correct the tendency of a right-handed golfer to "push" the club with his left hand; shifting the center of mass toward the heel likewise corrects the tendency to "pull" the club with the right hand. Changing the weight of a club, or shifting its center of mass upward or downward, can correct the tendency to swing or putt too hard or too soft.

Several patents, including U.S. Pat. Nos. 4,962,932 and 4,828,266, have attempted to address the problem of swingweighting a putter to correct for the deficiencies of a golfer's stroke. Both patents describe a putter head incorporating a weight-receiving system such that cylindrical weights may be fixed in either end of the putter head, thus shifting the center of gravity of the putter head toward the heel or toe end, or changing the overall weight of the putter so that more force is delivered for the same stroke. Further, U.S. Pat. No. 4,695,054 describes a putter head having a removable insert in its bottom portion, in which cylindrical weights may be added or removed to achieve the same purpose. Lastly, U.S. Pat. No. 4,979,744 describes a putter head having detachable toe and heel members, which in addition to lengthening the striking face of the putter can adjust the center of gravity of the putter head toward either the toe or the heel end.

Each of these methods of swingweighting suffers from the disadvantages of clumsiness and difficulty of adjustment. It can be appreciated that few golfers have the patience to disassemble, adjust, and reassemble their putters after each stroke, in the attempt to converge on the proper swingweight combination. More importantly, none of these devices provides a means for adjusting the center of mass of a putter head both in the toe-heel direction, and either upward or downward. Finally, and most importantly, none of these devices provides a means for accurately aligning the putter head initially so that it is perpendicular to the proper path.

Thus, there remains the need for a putter having a targeting system which enables the user to easily and accurately align the putter head with the target, and a putter having a system which compensates for deficiencies in the golfer's stroke, so that the proper head alignment is preserved upon impact with the ball.

SUMMARY OF THE INVENTION

In order to overcome the above stated problems and limitations, there is provided a targeting putter of the present invention. This putter comprises a putter head which connects to a putter shaft. The putter head has a striking face, a rearward face, a sole face, and a prism sighting member disposed substantially above the sole face, at a level above the striking face.

The prism sighting member is preferably a triangular reflecting prism, said prism having a front face, a top face, and a reflecting face. The prism is disposed such that the front face is substantially parallel to, and above, the striking face, and the top face is substantially parallel to, and above, the sole face.

Most importantly, either the front or top face of the prism is ground or manufactured by other means known in the art such that it has a concave aspect, enabling a wider view through the prism than a flat front face and top face would provide. A hairline is affixed to the front face, and another is affixed to the top face, such that when the putter head is aligned properly the two hairlines will substantially overlap.

The rearward face has counterbores, preferably one toward the toe end and one toward the heel end, which are adapted to removably retain rotatable cylindrical weights aligned substantially along the center of mass of the club. Each cylindrical weight has a portion of its mass removed, such that the center of mass of the weight is displaced some distance from the cylindrical axis. Preferably, the cylindrical weights have slots adapted for operation by a coin or screwdriver. More preferably, and in order to comply with the Rules of Golf, the cylindrical weights are retained in position by a screw or other removable fastener.

In operation by a golfer, the golfer first adjusts the cylindrical weights such that the center of mass of the cylinders is disposed either towards the toe or heel end of the putter head. This has the effect of moving the center of gravity of the putter either towards or away from the toe or heel end. Alternatively, the weights may be adjusted to a position either above or below the center of mass of the putter head, to move the center of mass of the putter either up or down. These adjustments are made in order to correct for the golfer's anticipated stroke deficiencies. The golfer then sights through the top face of the prism until the golf ball and the target are aligned, and the hairlines on the top and front faces substantially overlap, indicating that the putter head is properly positioned. The golfer then putts the ball.

The present invention therefore provides a sighting mechanism whereby the golfer may easily and accurately align the striking face of the putter perpendicularly to the precise path between the ball and a target. In particular, the sighting mechanism of the present invention is easy to manufacture, and provides a wide view of the playing field, largely unobstructed by the ball. Most importantly, however, the present invention also includes a unique and easily adjustable swingweighting mechanism for correcting the golfer's backstroke, to maintain the precise positioning of the striking face even as the ball is hit.

These and other aspects of the invention will become apparent from a study of the following description in which reference is directed to the following drawings.

DETAILED DESCRIPTION OF THE PREFERRED EMBODIMENT

Figure 2:
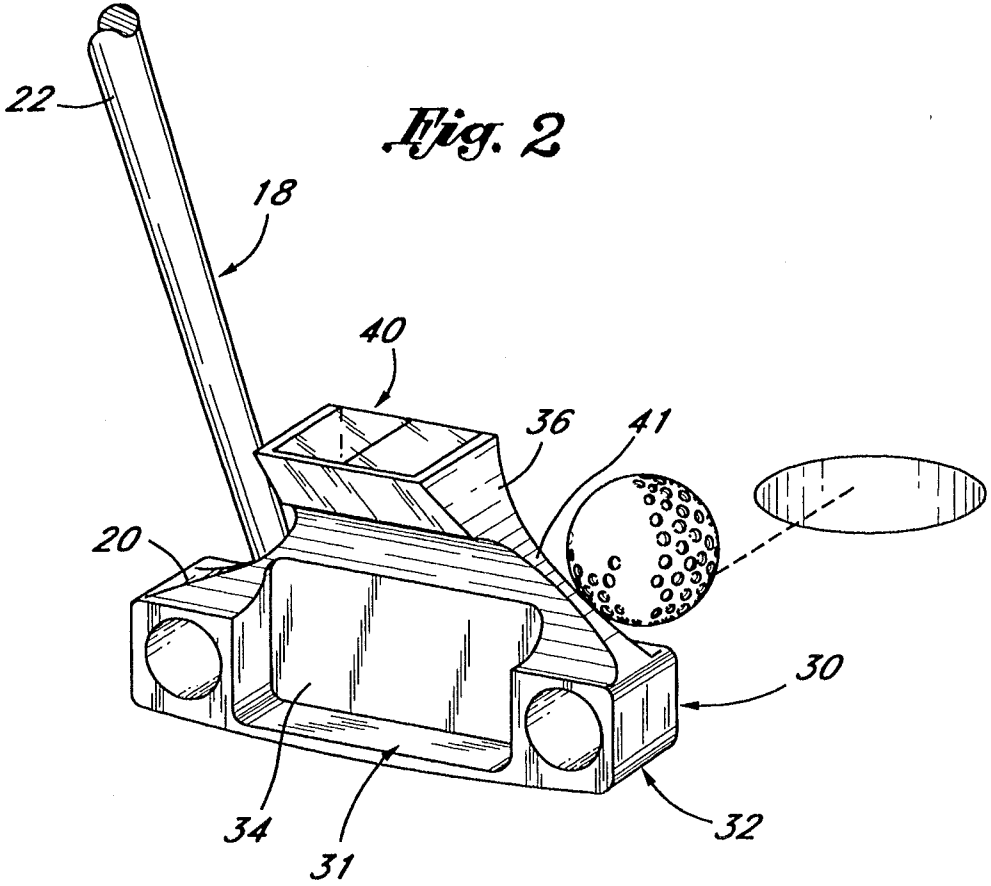
FIG. 2 is a perspective view of the putter of FIG. 1, as viewed from the rear.
Figure 1:
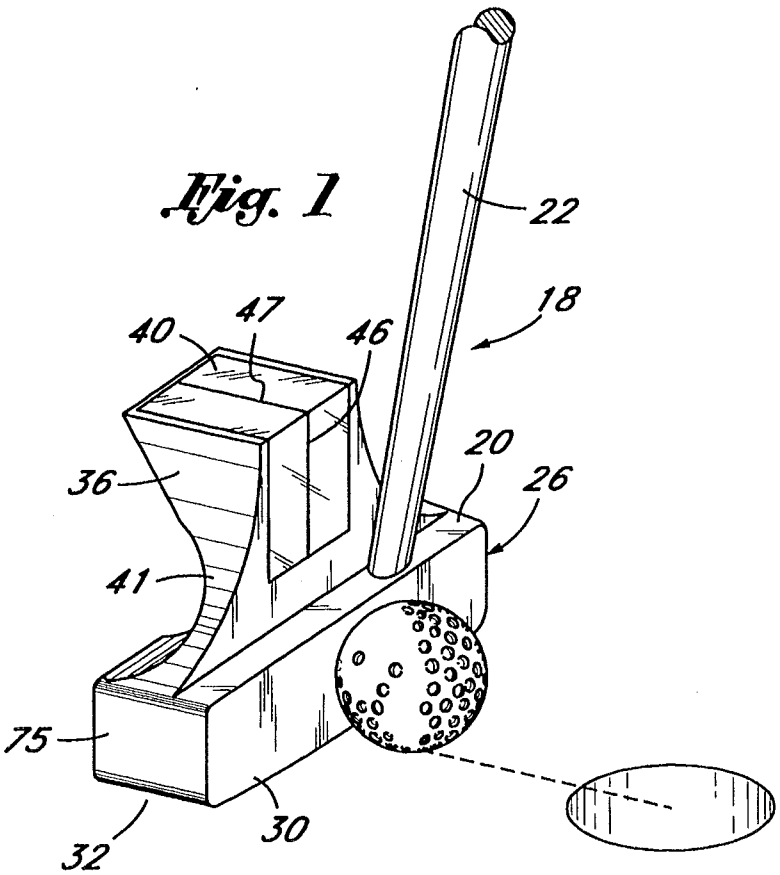
FIG. 1 is a perspective view of a putter of the present invention as viewed from the front side illustrating a portion of the putter shaft and a putter head.

FIGS. 1 and 2 illustrate a putter 18 in accordance with the present invention. In general, the putter 18 comprises a putter head 20 and a putter shaft 22.

FIGS. 4 through 7 describe the putter head in greater detail. In particular, the putter head 20 has a striking face 30, a sole face 32, a rearward face 34, and a prism or sight mounting area 36. The putter head 20 has a toe end 25 and a heel end 26. Preferably, the putter head 20 has an overall shape such that its center of mass lies on a point midway between the toe 25 and the heel 26 of the striking face 30, and at a distance above the sole face 32. This distance is preferably equal to half the height of a regulation golf ball, or ¾". In this manner, the center of mass of the putter 18 is directly behind the center of the golf ball when the golf ball is centered in front of the striking face 30 of the putter 18. The center of mass must be adjusted based on the specific shape of the putter head 20, the mass of a sighting prism 40, and the mass of a connected shaft 22, all of which are described in more detail below. Further, the overall mass of the putter head 20 is preferably about 10 oz.

The putter head 20 is preferably shaped such that the sole face 32 is slightly curved between the head 26 and toe 25, with the lowest point on the sole face 32 occurring midway between the toe 25 and heel 26. In this manner, the surface area which may drag on the putting surface is reduced. Further, it is preferred that the putter head 20 have a length which allows the striking face 30 to be between about 4" and 5". Besides having this length, the striking face 30 is also preferably at least 1" in height and is preferably precision ground to be as flat as possible, most preferably to within 1/10,000th of an inch.

Figure 5:
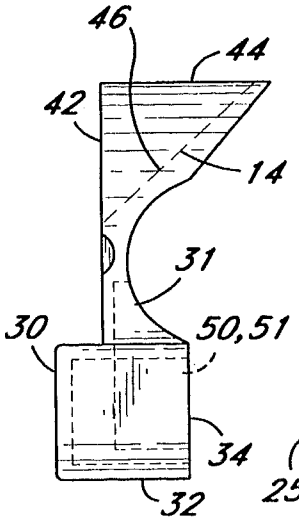
FIG. 5 is a side view of the putter head of FIG. 1.

The sight mounting area 36 is preferably located a substantial distance above the striking 30 and sole 32 faces and may have any variety of shapes which allows for placement of a prism 40. When a right triangular reflecting prism 40 is used, as described in greater detail below, the sight mounting area 36 is preferably somewhat triangular shaped itself, as illustrated in FIG. 5. However, in order to allow placement of the prism 40, the mounting area 36 is preferably recessed. In this manner, the mounting area 36 has a sloping face 14, the slope of which is designed such that when the prism 40 is placed therein the images are transmitted properly to the user, which, in the case of a right triangular prism, requires the slope to be 45°. Further, the area 36 has two sides 15, 16 which extend upwardly from the sloping face 14. These sides 15, 16 act to protect sides 48, 49 of the prism 40 which face the heel 26 and toe 25 ends of the putter 18, when installed.

Figure 4:
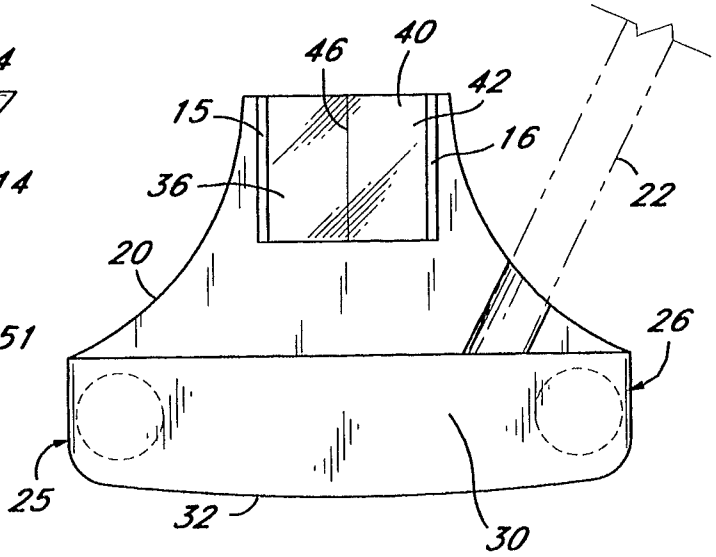
FIG. 4 is a front view of the putter head of FIG. 1 illustrating a portion front striking face and a reflecting prism having a hairline reticle located thereon.

The mounting area 36 is also preferably located along the length of the putter head 20 such that when in place, sighting through the prism 40 occurs in line with the center of gravity of the putter 18, i.e., halfway between the toe 25 and heel 26 of the putter 18. Preferably, therefore, the sighting area 36 is centered along the length of the putter head 20, as illustrated in FIG. 4.

The mounting area 36 may be connected to putter head 20 by an arcuate rib 41, although many shapes and designs for the connection of the mounting area 36 to the putter head 20 are contemplated. This rib 41, and the mounting area 36 may easily be milled, as described below.

The putter head 20 can be made of any hard, durable, corrosion- and weather-resistant material, such as stainless or other steels, tropical woods, plastics, or composites, but is most preferably made from aluminum, because of its excellent mechanical properties and ease of machining. When made of aluminum, the putter head 20 is most easily manufactured by milling or machining a block of aluminum into the desired shape, as opposed to forming and assembling individual pieces or the like.

Figure 6:
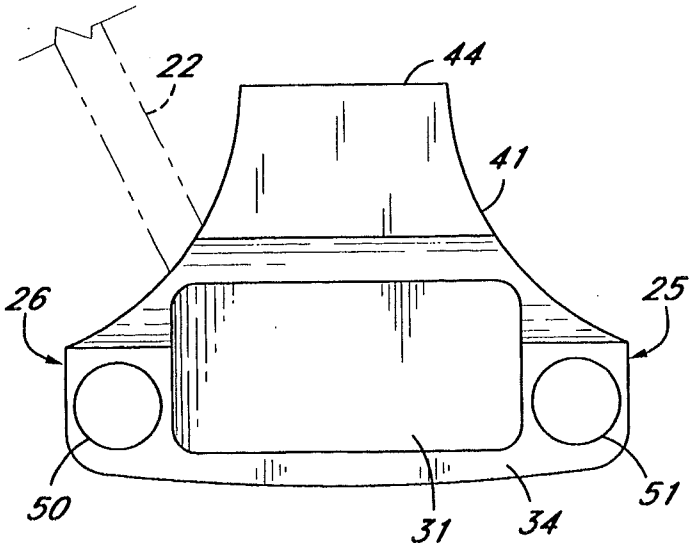
FIG. 6 is a rear view of the putter head of FIG. 1, illustrating the preferred position of the two weight receiving counterbores.

The center of mass may easily be adjusted by removing material from the rear face 34 of the putter head 20. For example, a recess 31 may be created in the rearward face 34 behind the striking face 30 in order to raise the center of gravity, as illustrated in FIGS. 5 and 6.

The putter head 20 is mounted at the end of a conventional putter shaft 22 by such means as are well known in the art. The putter shaft 22 is preferably connected near the heel 26 end of the putter 18 and exits the putter head 20 at an angle acute to the plane of the sole face 32. This angle may vary, depending upon the specific desire of the user, but is preferably between 55° and 80°, and more preferably is about 70°, so that the user may easily sight over the putter 20 when putting.

In order that the shaft 22 be rigid, and not excessively energy absorbing, the putter shaft 22 is preferably made of steel. However, aluminum, wood, composites, or the like are acceptable.

Figure 7:
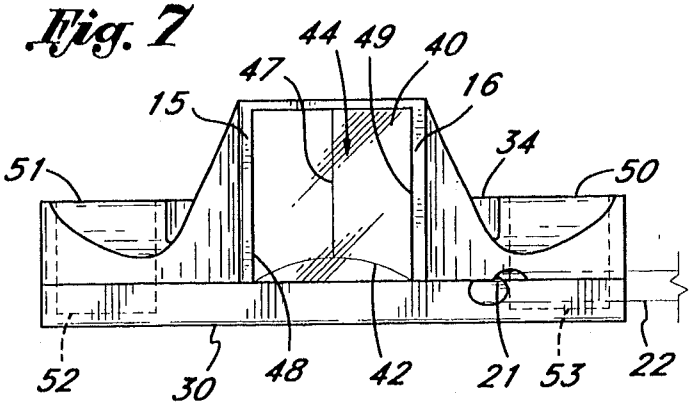
FIG. 7 is a top view of the putter head of FIG. 1, showing the top face of the reflecting prism with a hairline reticle located thereon.

As illustrated, the shaft 22 preferably exits the putter head 20 nearer the striking face 30 than the rearward face 34. This exit location prevents excessive interference with the rib 41 which connects the mounting area 36 to the putter head 20. In fact, a small recess 27 in the rib 41 may be necessary to allow passage of the shaft 22, depending on the depth of the putter head 20, as illustrated in FIG. 7. The exit location could be closer to the rearward face 34 or even centered, if desired. In any event, however, the shaft 22 should be connected to the putter head 20 at a location which does not interfere with any counterbore 50, 51 in the putter head 20, which counterbores 50, 51 will be described in more detail below. Further, the shaft 22 should be connected in a manner to prevent any interference with the sighting features of the putter 18.

In order to allow the user to easily align the putter 18 with the ball and a target, the putter 18 is provided with a unique sighting or reflecting prism 40. The purpose of the reflective prism 40 is to transmit images from in front of the putter head 20 to the user. The prism 40 is preferably a right triangular reflecting prism. This prism 40 has a front face 42, a top face 44, rear surface 46, and sides 48, 49, and is, as described above, disposed on the sight mounting area 36.

Preferably, as shown in FIG. 1, the reflecting prism 40, when so mounted, is at a height such that the top of a golf ball is only barely visible in the image reflected through its top face 44, thus providing a relatively unobscured view of the playing field and pin. This placement is most easily accomplished through proper design and location of the mounting area 36, on which the prism 40 is located. As illustrated in FIG. 5, when mounted, the top face 44 of the prism 40 lies in a plane perpendicular to the striking face 30, while the front face 42 lies in a plane parallel to the striking face 30. The rear surface 46, which is the "hypotenuse" of the top 44 and front 42 faces, is mounted against the sloped surface 14 of the mounting area 36.

The reflecting prism 40 may be secured to the putter head 20 through the use of any type of fastener or other means known in the art, although preferably it is fixed through the use of an adhesive applied on the reflective surface 46 and on the sides 48, 49 of the reflecting prism 40.

In order to transmit the image from the front face 42 to the top face 44, the reflecting prism 40 may be made of any transparent material, such as Lucite (methylmethacrylate) or other transparent polycarbonates, and is most preferably constructed of glass, because of that material's high scratch-resistance. Further, to reflect the image entering the front face 42 upwardly through the top face 44, the image must be reflected at the rear surface 46 of the prism 40. This reflection may be created by finely polishing the sloping surface 14 of the mounting area 36, which is located behind a polished, clear rear surface 46. Preferably, however, the rear surface 46 is itself a mirrored surface of the prism 40, created by polishing or silvering the rear surface 46 of the reflecting prism 40 before the prism 40 is installed on the putter head 20. In the preferred embodiment, the rear surface 46 is aluminized and coated with a protective overcoat and black paint. In this manner, any adhesive or the like placed between the rear surface 46 and the mounting area 36 will not be visible. Further, in the instance where the rear surface 46 is itself reflective, the rear surface 46 need not contact the sloping surface 14 of the mounting area 36. All that is required is that the prism 40 be securely fixed and positioned to transmit the image properly.

While the reflecting prism 40 is preferably a right triangular reflecting prism, other embodiments, such as a reflecting pentaprism, are contemplated by the Applicant. Other such prisms may easily be installed on said putter 18 by changing the configuration of the mounting area 36.

Most importantly, in order to aid the user in determining if the striking face 30 is perpendicular to the desired target, reticles 46 and 47 are inscribed or otherwise marked on the front face 42 and top face 44 of the reflecting prism 40. These reticles 46, 47 are preferably hairlines, although other markings may be used.

In order to increase the angle of view which may be had through use of the prism 40, either the front face 42 or the top face 44 of the reflecting prism 40 is ground or otherwise shaped such that it has a slight concavity. This concavity provides a wide angle of view through the reflecting prism 40, enabling easy location of the pin and target. Most importantly, when either face 42 or 44 is formed in this manner, it acts as a "lens." This "lens" has the effect of transmitting any image without distortion.

This "lens," and thus increased angle of view, is preferably created by grinding either face 42 or 44, and most preferably face 42, to a radius of curvature in the range of 5" to 10", and most preferably to a 7.049" radius of curvature, concave. It is noted that if no concavity is present, the angle of view is the same width and length as the front face 42 or top face 44 of the prism 40. As stated, the concavity of the front face 42 or top face 44 has the effect of increasing the angle of view dramatically. This increase in the angle of view is at the same time accompanied by a proportional decrease in the size of the sighted objects. Therefore, the concavity is preferably chosen to optimize the angle of view and yet not cause the size of the sighted objects to decrease excessively. Furthermore, all angles of the prism 40 of the preferred embodiment should have tolerances of ±5 arc minutes; all dimensional tolerances should be between +0.000" and −0.010"; all polished surfaces should be of better than 4 fringe power and 1 fringe irregularity; all non-polished surfaces should be ground 180 grit or finer; all edges should be chamfered 0.020" at 45°; and the surface quality should be 60/40 or better. In addition,, the optical and mechanical axes of the prism 40 of the preferred embodiment should be parallel to better than ±5 arc minutes, and concentric to better than ±0.010". The prism 40 is preferably of prism material BK7 grade B or better.

In order to allow for the adjustment of the swingweight, and thus allow the golfer to manipulate his or her stroke, counterbores 50 and 51 are provided in the rearward face 34 for acceptance of a swingweight 60. Preferably, two counterbores 50, 51 are provided, one each at the toe 25 and heel 26 ends of the rearward face 34, as shown in FIG. 6. The counterbores 50 and 51 are preferably located along a line passing through the center of mass of the putter head 20. Each counterbore 50, 51 is preferably ¾" in diameter and 1" deep. Other shapes of counterbores 50, 51 are possible, such as oval, square, triangular, or the like. Further, the exact size of the counterbores 50, 51 may be varied depending upon the size of the swingweight to be used therewith and the exact dimensions of the putter head 20. Further, other combinations of counterbores, including their placement at other locations, are contemplated. For example, counterbores might be placed in the heel 26 and the toe 25 of the putter 18 parallel to, but behind, the striking surface 30, and preferably along the line between the heel 26 and toe 25 on which the center of gravity of the putter 18 lies.

Figure 3:
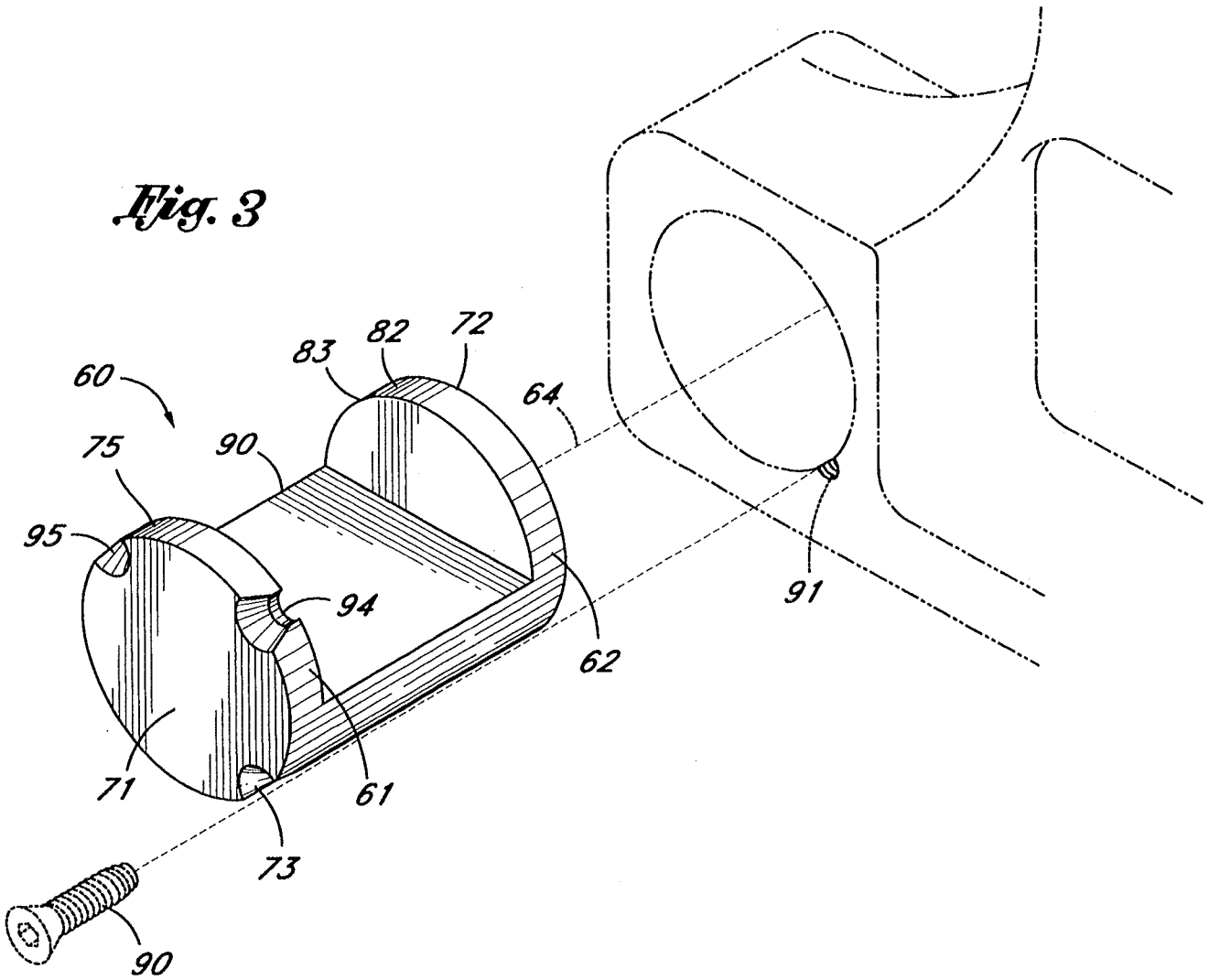
FIG. 3 is a perspective view of a swingweight of the present invention.

FIG. 3 illustrates a swingweight 60. The swingweights 60 for use in the counterbores 50, 51, generally comprise a body 80 having a centerline 64; and two caps 81, 82 having centerlines 83, 84, each cap 81, 82 located at an end 61, 62 of the body 80, with the centerlines 64, 83, 84 aligned. Preferably, the caps 81, 82 are manufactured as part of the body 80 itself.

Each swingweight 60 is preferably primarily cylindrical, and made of a high specific gravity, corrosion-resistant material, preferably metal, and most preferably brass or stainless steel. Each swingweight 60 preferably has a diameter which matches the diameter of the counterbore, which is, in this instance, approximately ¾". Preferably, however, the swingweights 60 are slightly smaller in diameter than counterbores 50, 51 for easy insertion into the counterbores 50, 51.

The overall length of the swingweights 60 may be the same as the length of the counterbores 50, 51. Preferably, however, so that more mass may be imparted by the swingweights 60, they may be somewhat longer than the counterbores 50, 51 and protrude slightly therefrom. In any case, each swingweight 60 should be designed for insertion into its corresponding counterbore 50, 51 until the interior end 72 contacts the inner end 52, 53 of the counterbore 50, 51. Therefore, the cap 82 which contacts the end 52, 53 of the counterbore 50, 51 should conform to the shape of the end 52, 53 of the counterbore 50, 51. The interaction between the end 72 of the swingweight 60 and the end 52, 53 of the counterbore 50, 51 prevents undesired dampening within the putter head 20.

In order that use of the swingweight 60 may allow for adjustment of the center of mass of the putter head 20, the swingweights 60 are asymmetric. Preferably, some portion, preferably half, of the body 80 of the swingweight 60 is removed such that the majority of its mass lies to one side of the centerline 64 of the swingweight 60. In this manner, rotation of the swingweight 60 about the centerline 64 causes the location of the center of mass of the swingweight 60 to change. In such an instance, the caps 81, 82 preferably retain a dimension which matches the counterbore 50, 51 so that the swingweight 60 securely engages the counterbore 50, 51.

The preferred design of the body 80 is such that half of the body 80 is removed, along a plane through the centerline of the body 80. Thus, in the instance where the counterbore 50, 51 is round, the body 80 is preferably a half-cylinder. Further, it is noted that where the caps 81, 82 are really one and the same as the ends 61, 62 of the body 80, removal of this mass from the body 80 occurs, in essence, by truncating the body 80 between its ends 61, 62. Lastly, the swingweight 60 need not, of course, be manufactured by removing material from an otherwise fully cylindrical body 80, but could merely be cut or molded into a shape which has the above-described characteristics.

It is possible, however, to remove other amounts of the body 80 of the swingweight 60 to vary the amount of weight on each side of its centerline 64. For example, one-third or one-quarter of the mass of the body 80 could be removed, leaving two-thirds or three-quarters of the weight, respectively. Once again, in order that the remaining body 80 mass lie off of the centerline 64, when such mass is removed, it is removed above a plane parallel to the centerline 64 of the body 80.

When half of the body 80 is removed, however, the overall mass of the swingweight 60 is preferably between 0.7 oz. and 2 oz., and most preferably about 1.2 oz. In this manner, the overall weight of the putter head 20 with the two swingweights 60 is about 12.4 oz. When more swingweight 60 mass is desired, a swingweight 60 where less mass has been removed form the body 80, or a larger swingweight 60 or a swingweight 60 made of a different material may be used.

In order that the swingweights 60 be firmly, yet adjustably and removably, retained in the counterbores 50, 51, in the preferred embodiment a parallel screw 90 engages a screw hole 91 parallel to, but offset from, the counterbores 50, 51. When fully tightened, the screw head 92 engages any of several notches 93, 94, 95, placed around the perimeter of the cap 81 of the swingweight 60, thus holding the swingweight firmly in the desired position. The interior end 72 of the swingweight 60 is preferably flat and smooth. The interaction between the swingweight end 72 and the counterbore end 52, 53 prevents dampening within the putter head 20.

Alternately, if quicker adjustment of the swingweights 60 is desired, the swingweights 60 may be held securely in place with O-rings or similar means. The O-rings can be located in grooves in the caps 81, 82 and protrude slightly therefrom to engage the counterbore 50, 51. This arrangement, however, has the disadvantage of causing some dampening during putting. When a small notch is made in the cap of the swingweight 60 in this embodiment, however, the swingweight 60 can easily be rotatably adjusted with a coin or the like.

Further, in order that the position of the swingweight 60 within the counterbore 50, 51 may be determined, small marks or notches 75 may be placed on the exterior end 71. These marks 75 indicate the position in which the swingweight 60 has been fixed in the counterbore 50, 51. These marks may be of any type suitable for this purpose.

Use of the Targeting Putter

To use the putter 18, the golfer grips the shaft 22 and assumes his or her normal putting stance, with the putter head 20 located behind the golf ball. Next, the golfer utilizes the unique prism 40 to align the putter head 20 with the desired target.

The desired target must be chosen by the golfer. For example, if there is no "break" on the putt and the ball is expected to travel in a straight line, the target is the flagstick or hole. If, however, the golfer expects a "break," then the target will be a spot some distance to either side of the flagstick or hole, the distance being equal to the amount of break.

Next, the golfer looks at the top face 44 of the prism 40 in order to view the putting surface at the level of the ball. The putter head 20 is rotated, keeping the putter head 20 behind the ball, until the image of the target lies along the reticles 46, 47 of the prism 40.

It is important to note that this task has heretofore been made difficult because of the angle of view of most putter prism sighting systems. With these systems, the line of sight is extremely narrow, and it has often been difficult to find the target in the prism image. Further, these systems have failed when the target is not the flagstick or hole. In the instant case, however, a target some distance from the flagstick may be easily sighted in the prism 40, because the angle of view is large enough to allow the image of the flagstick and target to be viewed at the same time.

After the target is aligned over the reticles 46, 47, both reticles 46, 47 must be carefully aligned over one another to ensure that the striking face 30 is perpendicular to the ball. The alignment of the reticles 46, 47 is accomplished by moving the putter head 20 while maintaining proper stance and maintaining the image of the target on the reticles 46, 47. It is noted that the ball is not used in the sight or alignment process. It is merely desired that the putter head 20 be centered behind the ball so that the center of gravity of the putter 18 and the center of the ball are aligned. This alignment provides optimum striking conditions.

Once aligned, the golfer may take his or her backstroke and hit the ball.

Often, as described above, the putter head 18 moves out of proper alignment during the putting stroke, or the golfer has a tendency to strike the ball too hard or too soft. In such instances, the swingweight system of the present invention is utilized to correct the problem.

Figure 8:
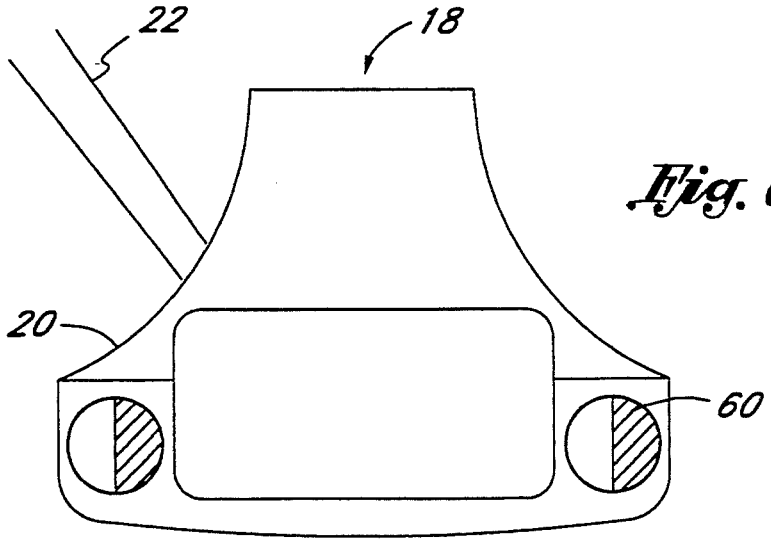
FIG. 8 is a rear schematic view of the putter head of FIG. 1, illustrating swingweights of FIG. 3 inserted into the putter head in their unadjusted or "sideways" position.

In the "unadjusted" mode, the swingweights 60 are normally located in the counterbore 50, 51, turned to a condition where the mass of each swingweight 60 is centered about the line of the center of mass of the putter 18, or "sideways," as shown in FIG. 8. In this position, the swingweights 60 add to the mass of the putter 18, but have no effect on the position of the center of mass.

Figure 9:
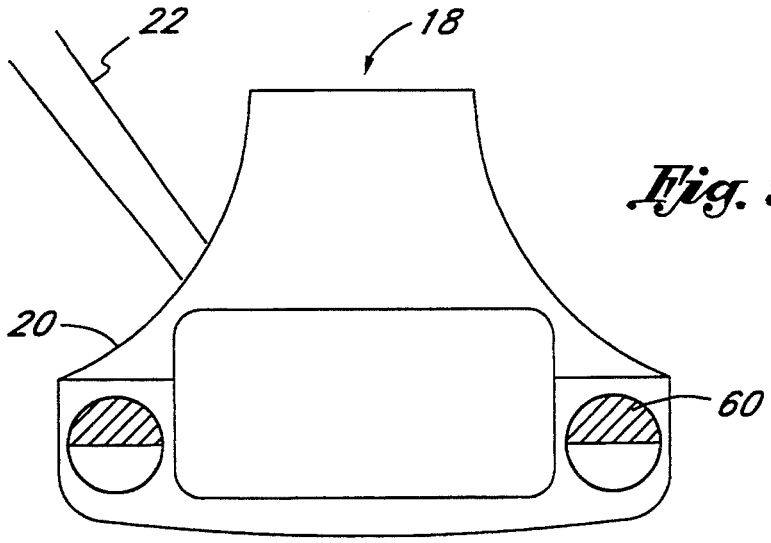
FIG. 9 is a rear schematic view of the putter head of FIG. 1, illustrating swingweights of FIG. 3 inserted into the putter head in their "up" position.

First, if the golfer is hitting the ball too hard, both swingweights 60 are adjusted to move the center of mass of the putter 18 upwardly, to lessen the overall "swingweight" and thus amount of energy gained during the swing, which energy is transmitted to the ball. This is accomplished by rotating both swingweights 60 to their "top" position, as shown in FIG. 9. This is a position in which the body 80 is on top, or above the centerline 64, of the swingweight 60.

Figure 10:
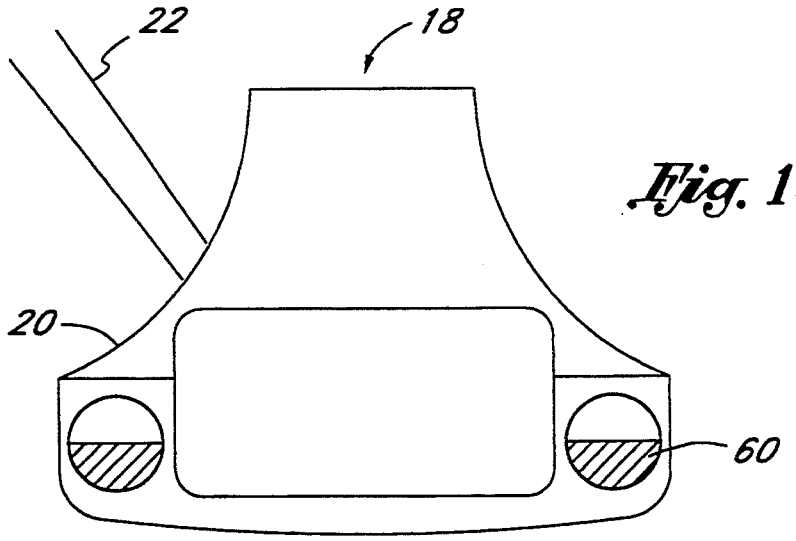
FIG. 10 is a rear schematic view of the putter head of FIG. 1, illustrating swingweights of FIG. 3 inserted into the putter head in their "down" position.

Alternatively, if the golfer is hitting the ball too softly, the swingweights 60 are turned in the opposite direction to increase the hitting force. In this arrangement, the mass of the body 80 of each swingweight 60 is located below centerline 64, or in the "down" position, as shown in FIG. 10.

Figure 11:
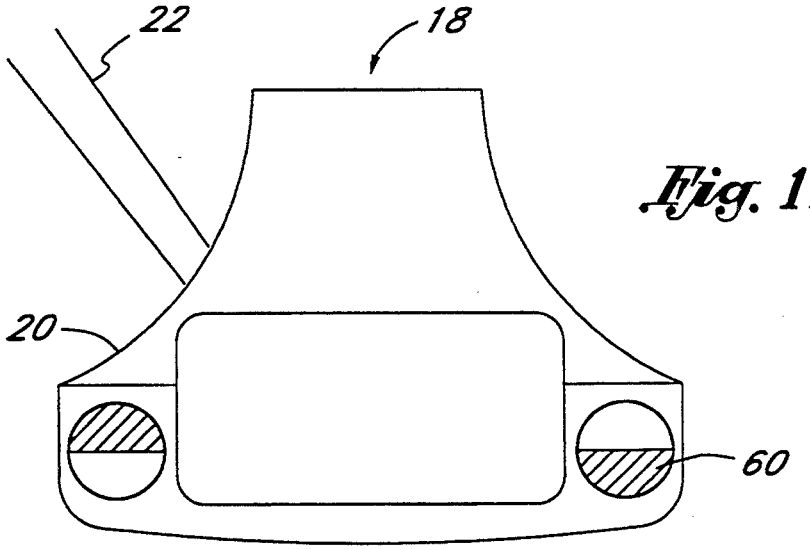
FIG. 11 is a rear schematic view of the putter head of FIG. 1, illustrating the heel swingweight in the "up" position and the toe swingweight in the "down" position.

If the golfer is "twisting" the putter head 20 such that the striking face 30 is striking the ball in a position other than perpendicular to the target, and thus driving the ball to the right of the desired target, the swingweight 60 in the heel 26 of the putter 18 if left-handed, and in the toe 25 if right-handed, must be increased. This is done by turning the respective swingweight 60 in the heel 26 or toe 25 from its unadjusted state to the "down" position, where the mass of the body 80 of the swingweight 60 is below the centerline 64. For greater effect, the opposite swingweight 60 may simultaneously be turned to the "up" position, where the mass of the body 80 of the swingweight 60 is above the centerline 64. An example of the right-handed adjustment, with the toe 25 swingweight 60 in the "down" position, and the heel 26 swingweight in the "up" position, is shown in FIG. 11.

Figure 12:
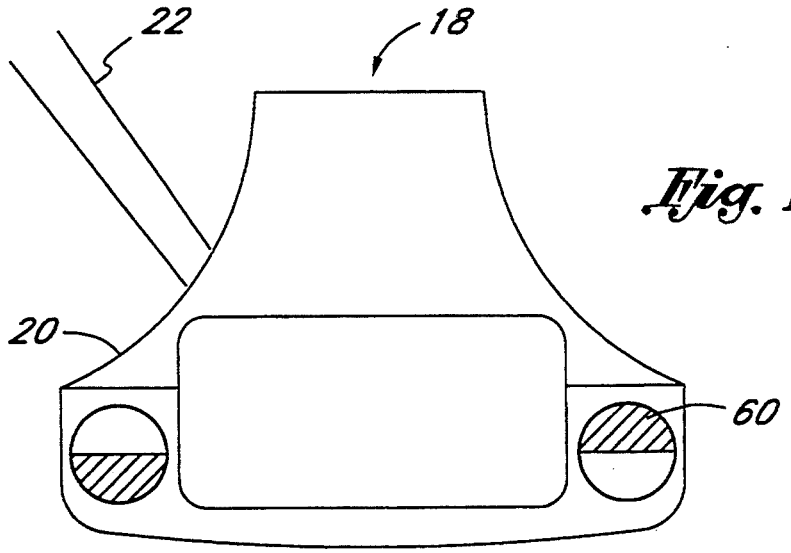
FIG. 12 is a rear schematic view of the putter head of FIG. 1, illustrating the toe swingweight in the "up" position and the heel swingweight in the "down" position.

Alternatively, if the golfer is driving the ball to the left of the target, the swingweight 60 in the toe 25 of the putter 18 if left-handed, and the heel 26 if right-handed, must be increased. This is accomplished by likewise rotating the correct swingweight 60 to its "down" position, as described above. Additionally, greater effect can be achieved by rotating the opposite swingweight 60 to its "up" position. An example of the right-handed adjustment, with the toe 25 swingweight 60 in the "up" position, and the heel 26 swingweight 60 in the "down" position, is shown in FIG. 12.

Each of the desired swingweight 60 position changes is easily accomplished in the preferred embodiment by removing the screw 90, turning the swingweight 60 to the desired position, and replacing the screw 90.

The amount of effect which the swingweight 60 will have in remedying each of these problems will depend upon the overall mass of the swingweight 60 and the exact shape of the swingweight body 80 as determined by the amount of the body 80 which is removed.

Thus, preferred embodiments of the invention have been illustrated and described with reference to the accompanying drawings. Those skilled in the art will understand that these preferred embodiments are given by way of example only. Various changes and modifications may be made without departing from the scope and spirit of the invention, which is intended to be defined by the appended claims.

We claim:

1. A golf club with improved alignment capabilities, comprising:

a shaft having a first and second end, the first end for gripping by a user and the second end for connection to a club head;

a club head connected to said second end of said shaft, said club head comprising a striking face located thereon, said club head further including a prism positioned to sight and align said striking face with a target through transmission of an image therethrough to a user, said prism including a first face for receiving, and a second face for transmitting, an image, said first face lying in a plane parallel to said striking face, and either said first face or said second face having a concave area located thereon, whereby the angle of view transmitted by said prism is widened.

2. The golf club of claim 1, wherein said prism is a right triangle prism.

3. The golf club of claim 1, wherein said prism is located above the striking face.

4. The golf club of claim 1, wherein said concavity in said first face or said second face has a radius of curvature of about 7 inches, concave.

5. A golf putter having a swing correction system, comprising:

a putter shaft;

a putter head connected to said shaft, said putter head having a toe end, heel end, and striking face, and a plurality of counterbores located in said toe and heel ends; and at least one swingweight for insertion into at least one of said counterbores, each of said swingweights having a main body portion having a centerline therethrough, said body portion having first and second ends, a first cap member in communication with said first end of said body portion, and a second cap member in communication with said second end of said body portion, said body portion contacting only a portion of either said first and second ends, such that the center of mass of said swingweight does not lie along said centerline.

6. The golf putter of claim 5, wherein said swingweight end caps are disc shaped, and said body is a cylinder having a diameter which is the same as said caps, and which is truncated in a plane along said centerline to form a half-cylinder.

7. The golf putter of claim 5, wherein said body portion of said swingweight is a partial cylinder truncated on a plane parallel to said centerline.

8. The golf putter of claim 5, wherein said body portion of said swingweight contacts no more than fifty percent of either said first and second cap members.

9. The golf putter of claim 5, wherein said body portion of said swingweight contacts not more than seventy-five percent of either of said first and second cap members.

10. The golf putter of claim 5, wherein said counterbores have a longitudinal axis which runs perpendicular to a line connecting said heel and toe ends.

11. The golf putter of claim 5, wherein said counterbores have a longitudinal axis which runs parallel to a line connecting said heel and toe ends.

12. The golf putter of claim 5, wherein said counterbores are cylindrical in shape and said swingweights are rotatably adjustable therein.

13. The golf putter of claim 12, wherein one of said cap members has a notch therein, whereby when said swingweight is inserted into said counterbore, said notches may be engaged by a screw, in order to hold said swingweight firmly in position relative to said counterbore.

14. The golf putter of claim 12, wherein each of said cap members includes means for indicating the position of said swingweight.

15. A golf putter having a swing correction system, comprising:

a putter shaft;

a putter head connected to said shaft, said putter head having a toe end, heel end, striking face, and a plurality of counterbores positioned between said toe and heel ends; and at least one swingweight for insertion into at least one of said counterbores, each of said swingweights having a body with first and second ends and a centerline therethrough, said body truncated between said first and second ends by a plane parallel to said centerline.

16. The golf putter of claim 15, wherein said plane through said swingweight body lies along said centerline.

17. The golf putter of claim 15, wherein said counterbores have a centerline located parallel to a line connecting said heel and toe ends.

18. The golf putter of claim 15, wherein said counterbores have a centerline located perpendicular to a line connecting said heel and toe ends.

19. A golf putter having optical sighting and swing correction systems, comprising:

a putter shaft;

a putter head connected to said shaft, said putter head having a plurality of counterbores therein;

an optical prism connected to said putter head, said prism having a first face for acceptance of an image and a second face through which the image accepted by said first face may be viewed, either said first face or said second face having a concave surface located thereon; and one or more asymmetric, adjustable swingweights for insertion into at least one of said counterbores in said putter head for selectively positioning the center of gravity of said putter, said swinging weights having a body with first and second ends and a centerline therethrough, said body being truncated between said first and second ends by a plane parallel to said centerline.

* * * * *